US006962510B1

(12) United States Patent
Chen et al.

(10) Patent No.: US 6,962,510 B1
(45) Date of Patent: Nov. 8, 2005

(54) ELECTRICAL CONNECTOR HAVING IMPROVED STRUCTURE REGARDING TERMINALS

(75) Inventors: Zhi-qiang Chen, Kunsan (CN); Ning Wang, Kunsan (CN); Quan Zhuang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/106,391

(22) Filed: Apr. 13, 2005

(30) Foreign Application Priority Data

Aug. 5, 2004 (CN) ..... 2004200784631

(51) Int. Cl.[7] ..... H01R 24/00
(52) U.S. Cl. ..... 439/660; 439/79
(58) Field of Search ..... 439/660, 629, 439/79

(56) References Cited

U.S. PATENT DOCUMENTS 5,158,471 A 10/1992 Fedder et al.
5,295,843 A * 3/1994 Davis et al. ..... 439/108
5,344,342 A * 9/1994 Briones ..... 439/620
5,587,884 A * 12/1996 Raman ..... 361/728
5,685,739 A * 11/1997 Davis et al. ..... 439/607
5,755,595 A * 5/1998 Davis et al. ..... 439/607
5,984,725 A * 11/1999 Belopolsky et al. ..... 439/607
6,039,583 A * 3/2000 Korsunsky et al. ..... 439/101
6,183,300 B1 * 2/2001 Belopolsky et al. ..... 439/607
6,270,379 B1 8/2001 Huang et al.
6,338,631 B1 * 1/2002 Hashimoto et al. ..... 439/79
6,394,846 B1 * 5/2002 Belopolsky et al. ..... 439/620
6,435,912 B1 8/2002 Zhu et al.
6,719,594 B1 * 4/2004 Yuzawa ..... 439/862
6,755,689 B2 * 6/2004 Zhang et al. ..... 439/607

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector (1) includes an insulative housing (10), a plurality of terminals (20) received in the housing, and a shell (30) surrounding the housing. The insulative housing includes a base portion (11) defining a plurality of passageways (111) extending therethrough, and a tongue portion (12) extending forwardly from the base portion. One of the passageways extends from the base portion into the tongue portion. One of the terminals is located adjacent to and outside of the tongue portion.

11 Claims, 5 Drawing Sheets

ELECTRICAL CONNECTOR HAVING IMPROVED STRUCTURE REGARDING TERMINALS

BACKGROUD OF THE INVENTION

1. Field of the Invention

The present invention generally relates to an electrical connector, and particularly relates to an electrical connector having improved structure regarding terminals. This application relates to a contemporaneously filed application titled "ELECTRICAL CONNECTOR HAVING STRUCTURE FOR PREVENTING DEFLECTED-INSERTION' having the same applicants and the same assignee with the instant application.

2. Description of Related Arts

Due to the booming development of the electronic industry, electro-consumer products become more and more popular. Miniaturization, integration and multi-function have been the inevitable trends what those products develop to. It also desires more power signals to be given to the electrical equipments, in respect that the integrated circuits have more applications, and the densities of the electrical components connected to the integrated circuits become much higher. To obtain more input power, power connectors of the electro-consumer products often need more conductors. U.S. Pat. No. 5,158,471 discloses a power connector having many contacts, which are densely arranged in an insulative housing. However, a bare periphery of those contacts makes them vulnerable and having poor orientation ability. Therefore, when a complementary connector is inserted into the power connector, once the insertion direction has just a little deflection, those non-protective contacts would be forced and tend to warp even breaking off, which may results in signals shut off.

U.S. Pat. No. 6,270,379 discloses a new electrical connector, a notch formed at a distal end of each contact mates with a corresponding protuberance formed on an insulative housing to prevent the contact from displacing. Nevertheless, the configuration of this connector would make the contacts of a complementary connector touch the terminals firstly while the connector mates with the complementary connector. Once the inserting direction of the complementary connector deflects, terminals would still warp even breaking off. Furthermore, distal ends of all terminals locked in the housing are not in favor of radiating heat resulting from transmitting of signals in high speed connectors.

Hence, it is desirable to provide an improved electrical connector to overcome the above-mentioned disadvantages of the related art.

SUMMARY OF THE INVENTION

It is an object of the present invention to provide an electrical connector having securing structure for preventing the terminals from warp even breaking off.

It is another object of the present invention to provide an electrical connector having better heat-radiation function.

In order to achieve the above-mentioned objects, an electrical connector in accordance with the present invention has an insulative housing and a plurality of terminals. The insulative housing comprises a base portion defining a plurality of passageways extending therethrough, and a tongue portion extending forwardly from the base portion. One of the passageways extends from the base portion into the tongue portion. One of the terminals is located adjacent to and outside of the tongue portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
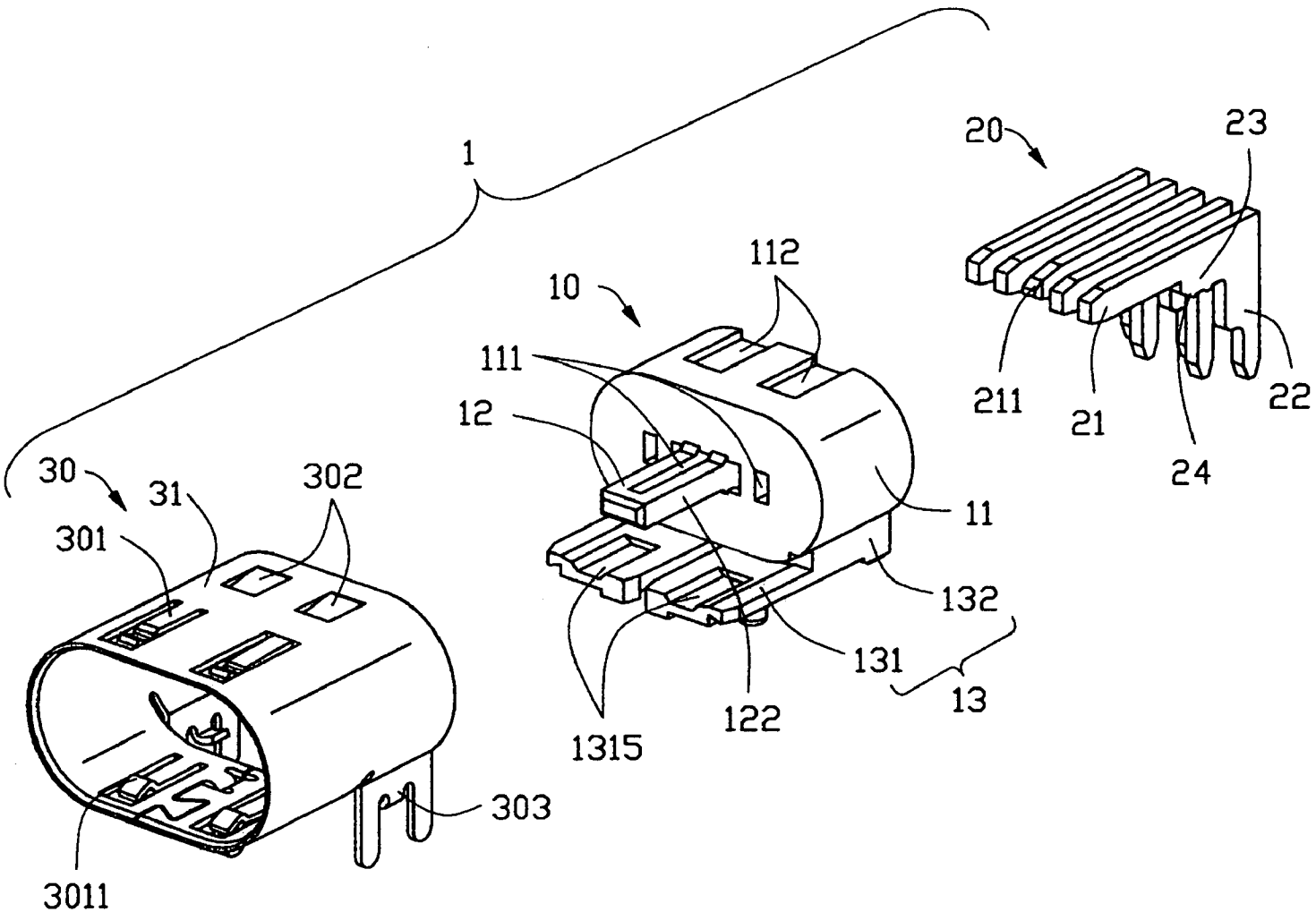
FIG. 1 is a front exploded, perspective view of an electrical connector in accordance with the present invention.

Reference will now be made to the drawing figures to describe the present invention in detail.

Figure 2:
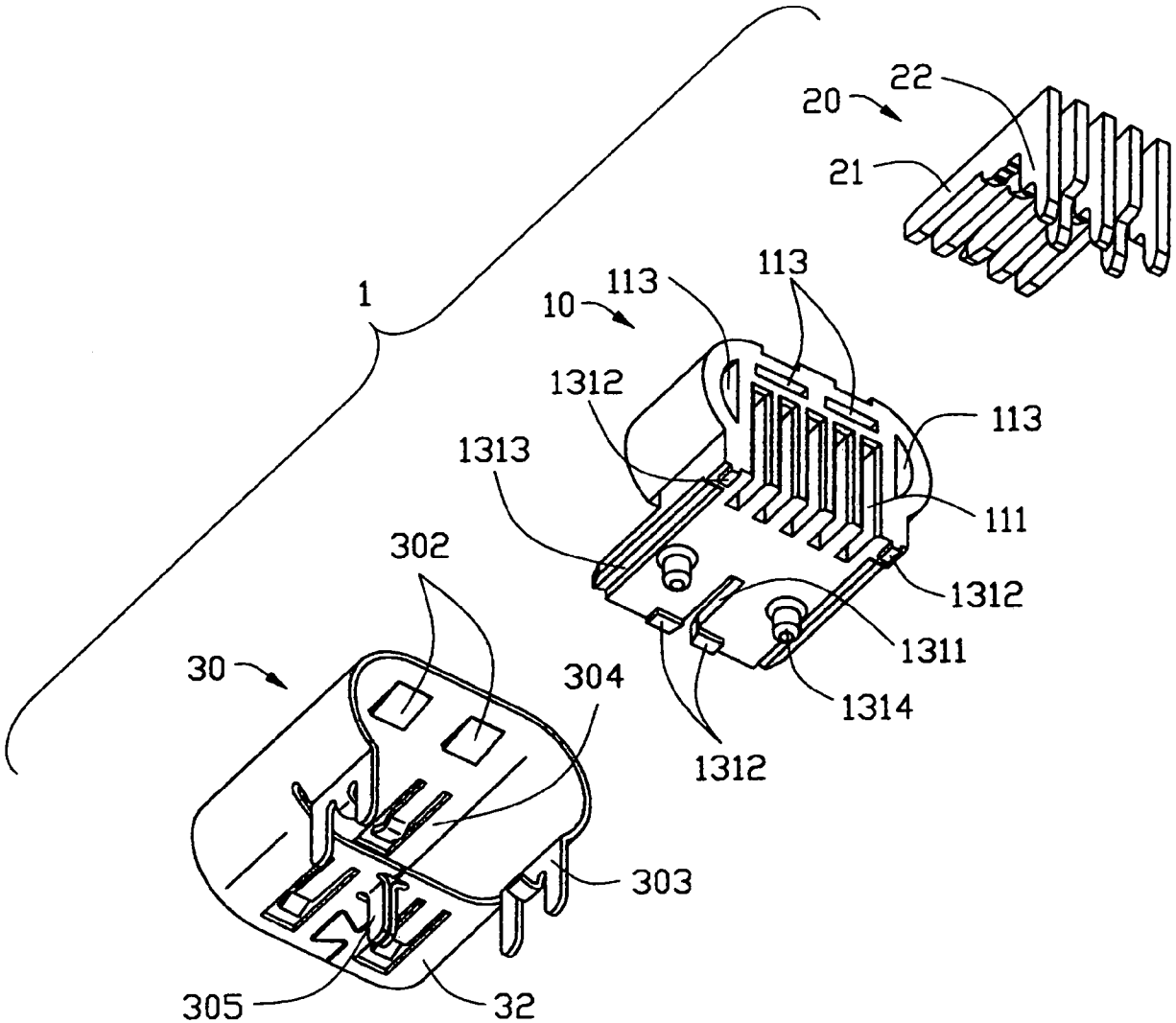
FIG. 2 is a view similar to FIG. 1, but taken from a rear perspective.

With reference to FIGS. 1–2, an electrical connector 1 in accordance with the present invention comprises an insulative housing 10, five terminals 20 received in the housing 10 and a shell 30 surrounding the housing 10. In this embodiment, only the third terminal 20 engaging with the insulative housing 10 is shown for illustrating the objects of this invention aforementioned.

The insulative housing 10 comprises a base portion 11 with an approximately elliptic cross-section, and five receiving passageways 111 extending through the base portion 11 along a front-to-back direction. A plate-like tongue portion 12 with two outer flanks 122 extends forwardly from a front face (not labeled) of the base portion 11. The third passageway 111 further extends onwards into and vertically runs through the tongue portion 12, until a certain distance is left to the front part thereof. In practice, tongue portion 12 can be provided at the site of every passageway 111. At least one passageway 111 does not extend tongue portion 12 at its lateral. A mounting portion 13 extends downwardly from the base portion 11, which includes a plate-like bottom plate 131 and a vertical portion 132 interconnecting the bottom plate 131 and an undersurface of the base portion 11. The bottom plate 131 horizontally prolongs from the vertical portion 132 and is in parallel with the above-mentioned tongue portion 12.

Referring to FIGS. 1–2, an upper face of the base portion 11 of the insulative housing 10 has two rectangular indentations 112. With reference to FIG. 2, as looked from the rear perspective, rears of the receiving passageways 111 extend downwardly and cross the vertical portion 132 and bottom plate 131 of the mounting portion 13. Several through-holes 113 are defined around the receiving passageways 111 in the base portion 11. A channel 1311 is defined vertically through the bottom plate 131 from the middle of a front portion thereof along a front-to-back direction. On a bottom face of the bottom plate 131, several stand-offs 1312 are formed to uplift the electrical connector 1. It can prevent the high temperature from warping of the bottom plate 131, and the whole bottom plate 131 from touching the PCB, which would result in taking up more place of PCB. Two grooves 1313 are defined at two side edges of the bottom face of the bottom plate 131 respectively, wherefrom a pair of guiding post 1314 downwardly extend. The front portion of the bottom plate 131 is divided into two parts by the aforementioned channel 1311. The upper faces of the two parts form two cutouts 1315 from distal ends respectively.

In this embodiment, there are totally five terminals 20 which are all L-shaped and configured nearly the same. Each terminal 20 has a mating portion 21 extending forwardly for engaging with a contact of a complementary connector, and a connecting portion 22 extending downwardly for connecting to the PCB. From a rear of each mating portion 21 protrudes downwardly a retaining portion 23 at the joint of the mating portion 21 and connecting portion 22. Several barbs 24 are formed at the lowest part of the retaining portion 23 to fixedly retain the terminal 20 in corresponding receiving passageway 111. The exactly middle terminal, in this embodiment the third terminal 20 approximately configures the same as the other four terminals, except that the mating ends 211, just the distal ends of the mating portion 21, of the other four terminals 20 are straight lines respectively looked from side, while that of the third terminal 20 is a protuberance, just as an arc looked from side. Two neighboring terminals 20 of the third terminal extend the same direction as the tongue portion 12 with each having a side face clinging to one flank 122 of the tongue portion 12.

The electrical connector 1 of present invention also includes a shell 30 with an approximately elliptic cross-section too. It has a pair of upper and lower walls 31, 32 parallel with each other. Each wall has two spring beams 301 formed thereon, and each beams 301 has a contacting portion 3011 bent inwardly into the inner of the shell 30 respectively. Two spring tabs 302 concaved downwardly are formed on the upper wall 31 corresponding to the rectangular cutouts 112 of the insulative housing 10. A positioning leg 305 extends downwardly from the lower wall 32 of the shell 30. A rear portion of the lower wall 32 forms a rectangular gap 304. Two sides of the gap 304 respectively extend downwardly a plate-like mounting leg 303, each of which is split into three parts.

Figure 3:
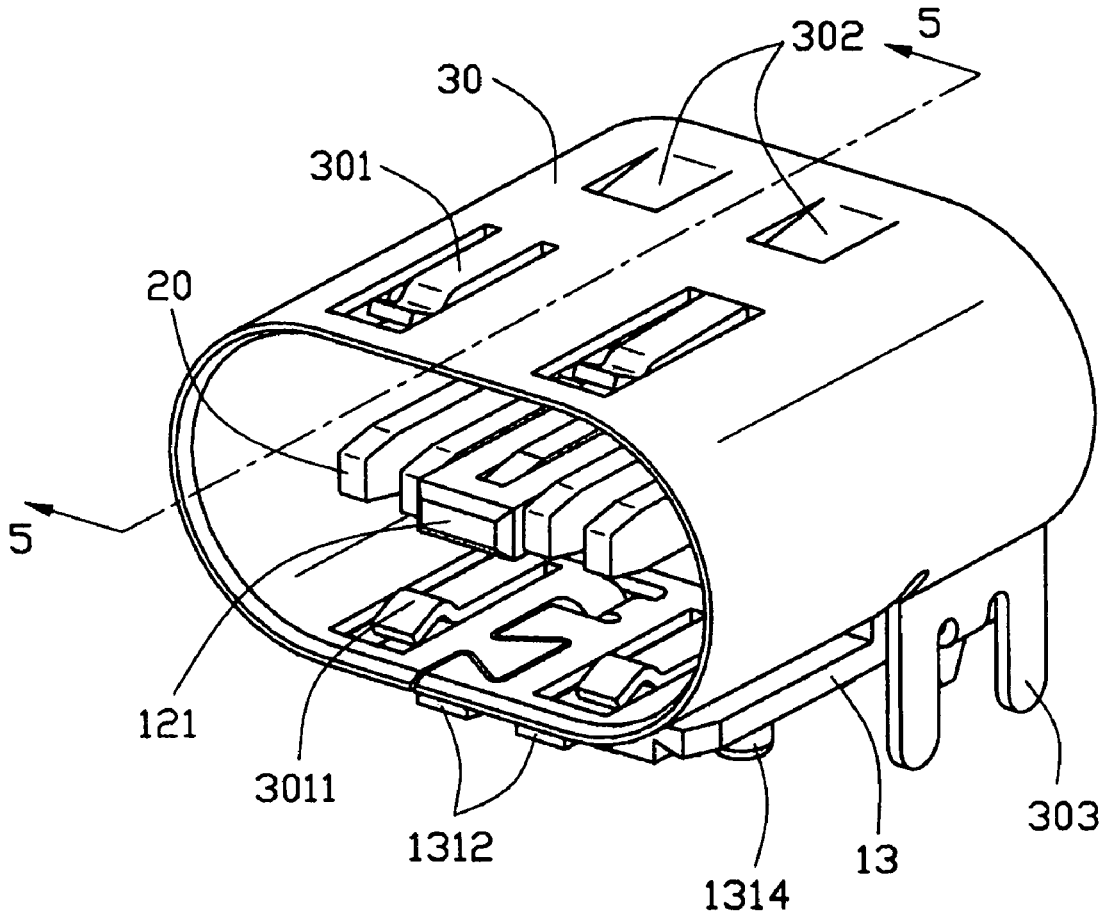
FIG. 3 is a front assembled perspective view of the electrical connector of FIG. 1.
Figure 4:
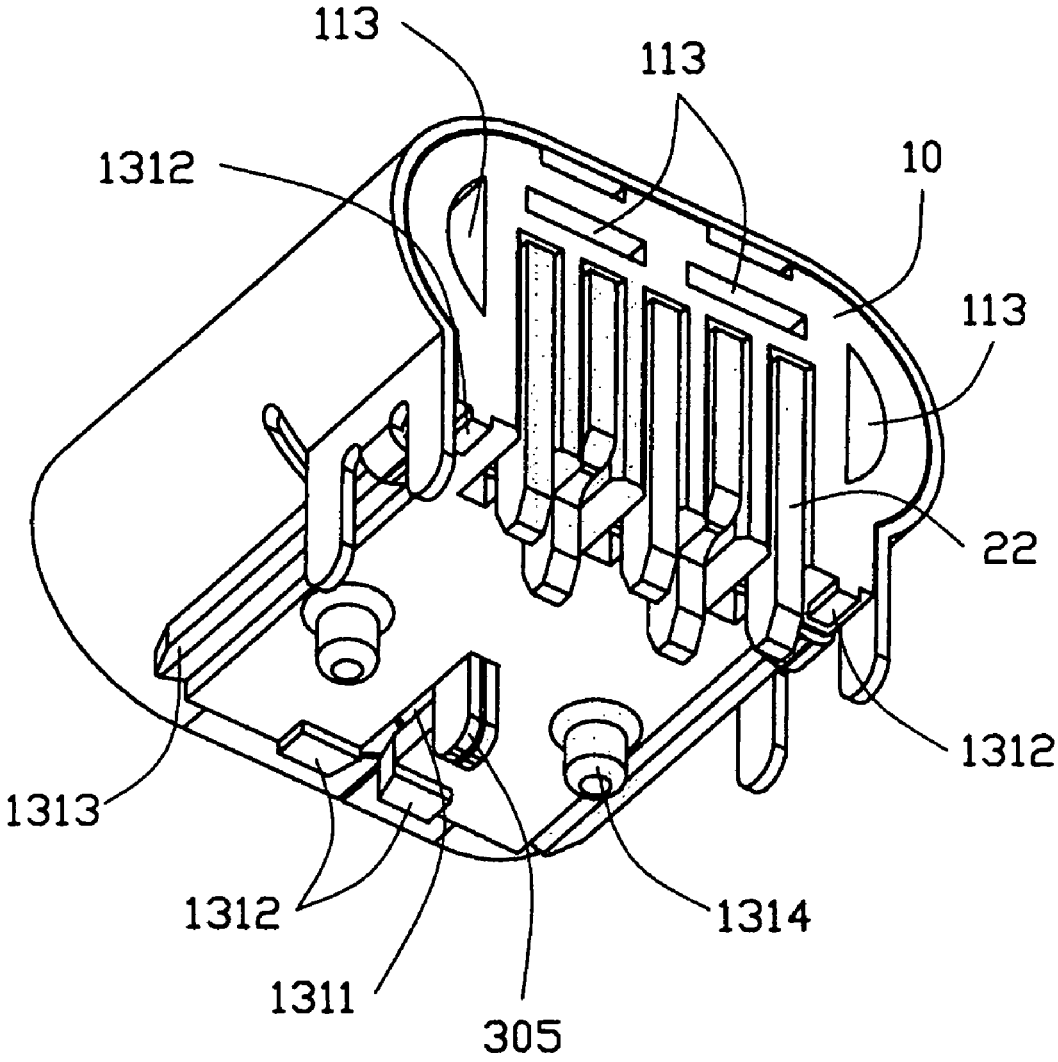
FIG. 4 is a view similar to FIG. 3, but taken from a rear perspective.

With reference to FIGS. 3–4, in assembly, the horizontal mating portions 21 of terminals 20 are firstly inserted into corresponding receiving passageways 111 from their rears. Conjunctively taking reference to FIG. 5, because the third receiving passageway 111 vertically runs through the tongue portion 12, two faces of the middle terminal 20 are exposed out thereof. With the height of a front of each receiving passageway 111 being the same as that of the mating portion 21 of each terminal 20, when each terminal 20 is completely inserted, the mating portion 21 thereof is retained received in each receiving passageway 111. A step portion 1111 is formed in the midst of each receiving passageway 111 corresponding to the configuration of each terminal 20, against which a front of the retaining portion 23 abuts. Plural barbs 24 interferentially retain with the inside surface of each receiving passageway 111 to fixedly receive the terminal 20 therein. The rear of each receiving passageway 111 extending downwardly across the insulative housing 10 forms a low back surface 1112 to abut against the vertical connecting portion 22 of each terminal 20. The step portion 1111 and the low back surface 1112 can effectively preventing each terminal 20 from abnormally forward moving.

Figure 5:
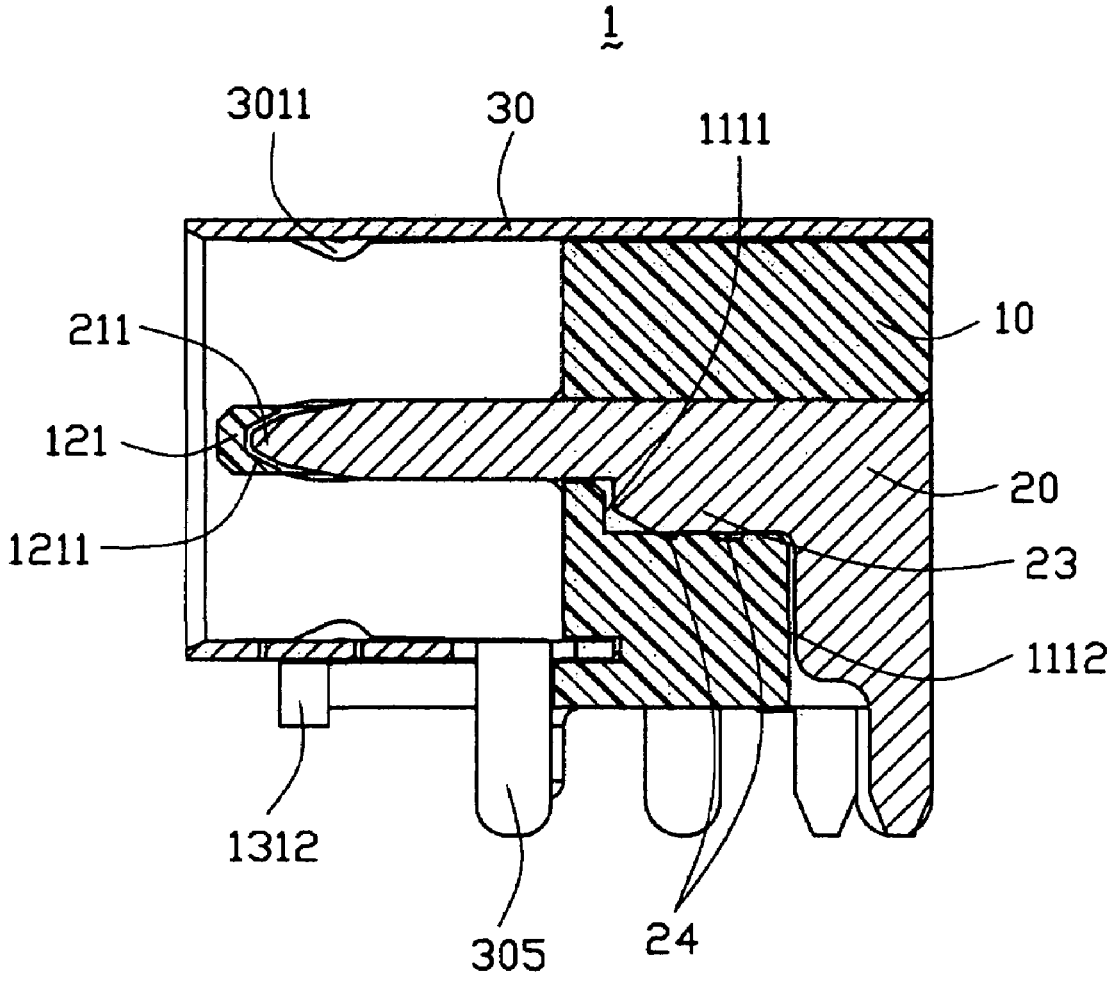
FIG. 5 is a cross-sectional view taken along line 5—5 of FIG. 3.

Taking reference to FIG. 5 in detail, it is a cross-sectional view taken along line 5—5 of FIG. 3. It is shown that the third receiving passageway 111 extends forwardly into the tongue portion 12 until a distal front end 121 is left. An arc-shaped notch 1211 is formed in communication with the receiving passageway 111 by concaved into a back face of the front end 121, into which the third terminal 20 extends, so the protrusive mating end 211 thereof is suitably locked in the notch 1211. It is noted that the distance between a deepest point of the notch 1211 and the step portion 1111 of the third receiving passageway 111 is equal to that between the distal end of the mating portion 21 and a very front of the retaining portion 23 of the third terminal 20. It can assure a fixed mating of the mating end 211 of the middle terminal 20 and the notch 1211 of the tongue portion 12. This kind of arc-shaped protrusion-notch engagement structure enhances the strength of the mating section of the terminal 20 and the tongue portion 12. Therefore, when a complementary connector mates with this electrical connector 1, it can endure repeated deflective insertion sturdily by effectively avoiding the damage to the front end 121 of the tongue portion 12, thereby greatly cut down the probability of warp even breaking off of the terminals 20. The neighboring terminals 20 of the tongue portion 12 extend with each having a side face clinging to one flank 122 of the tongue portion 12, so they can also be protected by the tongue portion 12 from deflection toward the tongue portion 12. Because the third receiving passageway 111 vertically runs across the upper and lower faces of the tongue portion 12, terminal 20 received therein has two faces exposed outside which can contact with the contacts of a complementary connector, therefore enhances the dependability of mating with complementary contacts.

The shell 30 of this invention is assembled to the insulative housing 10 either before or after the terminals 20 been received in the housing 10. The insulative housing 10 inserts into the shell 30 from its rear with the base portion 11 and tongue portion 12 inserted into the inside of the shell 30 and the mounting portion 13 exposed out of it. The insulative housing 10 is pushed forwardly with the plate-like positioning leg 305 getting into the narrow channel 1311 until the vertical portion 132 is stopped by a front of the rectangular gap 304 formed on the lower wall 32 of the shell 30. The two spring tabs 302 of the shell 30 extend into respective rectangular indentations 112 of the insulative housing 10 and abut against fronts thereof. Each mounting leg 303 is split into three parts and the middle one is bent to clamp into the respective groove 1313 at the side of the bottom plate 131 of the mounting portion 13, which make the shell 30 retain to the insulative housing 10 well.

The complete configuration of this electrical connector 1 is shown in FIG. 3. Each spring beam 301 of the shell 30 has an inward bending contacting portion 3011 to impose a certain retaining force to an inserted complementary connector, thereby assure a close mating. The vertical parts of the mounting legs 303 are soldered to the PCB. The number of spring beams 301 formed on the shell is at least one, in this embodiment there are four ones. The mating end 211 of the third terminal 20 can be configured as other shapes of protrusion, of course the inside surface of the corresponding notch 1211 formed on the tongue portion 12 should be made to the same as it to assure good mating. The terminals 20 also can be configured as a straight line or the other shapes.

As aforementioned, at least one receiving passageway 111 does not extend tongue portion 12 at its lateral, so this electrical connector 1 functions well in radiating the heat resulting from the transmitting of signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing comprising a mounting portion with a bottom plate and a base portion defining a plurality of passageways extending therethrough, and a tongue portion extending forwardly from the base portion, one of the passageways extending from the base portion into the tongue portion; a plurality of terminals received in the passageways, one of the terminals located adjacent to and outside of the tongue portion;

wherein the tongue portion defines a notch in communication with the passageway and the terminal received in the passageway of the tongue portion has a protrusion extending into the notch;

wherein the tongue portion defines a front end, and wherein the notch is defined in a back face of the front end;

wherein the tongue portion defines an upper and a lower surfaces, the passageway extending into the tongue portion vertically run across the upper and the lower surfaces;

and a shell with an approximately elliptic cross-section, and the base portion received in the shell has an approximately elliptic cross-section too;

wherein the shell comprises an upper wall and a lower wall, the bottom plate comprises an upper face and a lower face, and the lower face of the bottom plate is located outside of the lower wall of the shell;

wherein the lower face of the bottom plate defines grooves at two sides respectively, the shell comprises mounting legs downwardly extending from two sides thereof and split into several parts, and one part of the mounting leg is bent for clamping into the respective groove.

2. The electrical connector as described in claim 1, wherein the insulative housing comprises a mounting portion lower than the base portion.

3. The electrical connector as described in claim 2, wherein the mounting portion comprises a bottom plate and a vertical portion interconnecting the base portion and the bottom plate.

4. The electrical connector as described in claim 3, wherein the bottom plate of the mounting portion extends in a direction the same as and is parallel with the tongue portion.

5. The electrical connector as described in claim 1, wherein the upper face of the bottom plate defines at least one cutout thereon, the lower wall of the shell forms corresponding spring beams, each spring beam comprising an inwardly curved contacting portion located above the cutout.

6. The electrical connector as described in claim 1, wherein the base portion defines indentations thereon, the upper wall of the shell forms spring tabs for abutting against corresponding indentations.

7. The electrical connector as described in claim 1, wherein the lower wall of the shell has a positioning leg extending downwardly therefrom, the bottom plate defines a channel with an end engaging with the positioning leg.

8. An electrical connector comprising:

an insulative housing including a base;

a plurality of juxtaposed contacts disposed in the base and including contacting sections extending forwardly beyond the base; and a mating tongue integrally extending forwardly from the base; wherein at least one of said contacting sections is essentially received in the mating tongue except opposite upper and lower edges vertically protruding beyond the mating tongue for mechanical and electrical engagement with a corresponding terminals of a complementary connector, and at least another of said contacting sections is essentially exposed outside of the mating tongue under a condition that said another abuts against a lateral side of the mating tongue in a support manner; and wherein the tongue portion defines a notch in communication with the passageway and the terminal received in the passageway of the tongue portion has a protrusion extending into the notch;

wherein the tongue portion defines a front end, and wherein the notch is defined in a back face of the front end.

9. The connector as claimed in claim 8, wherein said one is rearwardly offset from said another in a mating direction.

10. The connector as claimed in claim 8, wherein a front end of said mating tongue is essentially located in front of that of said another.

11. An electrical connector comprising:

an insulative housing including a base;

a plurality of juxtaposed contacts disposed in the base and including contacting sections extending forwardly beyond the base;

a mating tongue integrally extending forwardly from the base;

a metallic shell circumferentially enclosing the mating tongue and defining a mounting leg section at a centerline of said housing; wherein only one of said contacting sections is essentially received in the mating tongue with opposite upper and lower edges vertically protruding beyond the mating tongue for mechanical and electrical terminals of a complementary connector under a condition that said only one of said contacting sections is essentially aligned with said mounting leg section in a vertical direction;

wherein said housing further includes a bottom plate extending forwardly from the base and below the shell, and said bottom plate defines a slot through which said mounting leg section extends; and wherein said slot is aligned with said only one of the contacting sections in the vertical direction.

* * * * *